United States Patent [19]

Yamashita

[11] 4,244,701

[45] Jan. 13, 1981

[54] POWDERED FUEL (GASOLINE SUBSTITUTION)

[75] Inventor: Yasui Yamashita, 631 Park Ave., Hot Springs, Ark. 71901

[73] Assignee: Yasui Yamashita, Hot Springs, Ark.

[21] Appl. No.: 41,759

[22] Filed: May 23, 1979

[51] Int. Cl.[3] ..... C10L 5/00

[52] U.S. Cl. ..... 44/1 C; 149/72

[58] Field of Search ..... 44/1 C; 149/72

[56] References Cited

U.S. PATENT DOCUMENTS 66,378 7/1867 Neumeyer ..... 149/72

FOREIGN PATENT DOCUMENTS 13581 of 1885 United Kingdom ..... 149/72
19928 of 1909 United Kingdom ..... 44/1 C
321695 11/1929 United Kingdom ..... 44/1 C
299396 1/1930 United Kingdom ..... 44/1 C
503480 4/1939 United Kingdom ..... 44/1 C

*Primary Examiner*—Carl F. Dees

[57] ABSTRACT

A fuel in the form of a powder which is used for combustion engines, and including a process whereby the fuel is made; the fuel including charcoal, hard coal, grain chaff, gun powder, alcohol and water, while the process confines the temperatures at which the process is conducted.

2 Claims, No Drawings

POWDERED FUEL (GASOLINE SUBSTITUTION)

This invention relates generally to fuels for internal combustion engines.

It is well known that, at this time, there is a great deal of concern in many countries of the world regarding the availability of adequate amounts of fossil fuel, particularly in the light of the political uncertainties of those countries having most of the world's oil. This, together with the increasing need for more oil everywhere, and the prospect of eventually running out of it at last, has finally caused a search for a new source of power. It is, with this in mind, that research has resulted in the creating of the following-described, new fuel.

A principal object of the present invention is to provide a new type of fuel, for use in internal combustion engines, and which is a substitute for gasoline.

Another object is to provide a new type of fuel, which is in the form of a powder, and which is made from ingredients that are not derived from underground petroleum oil, such as gasoline, so that there is no dependency on oil-producing countries for obtaining it, in view of the fact that it can be made anywhere in the world.

Another object is to provide a powdered fuel, which comprises principally charcoal, hard coal, grain chaff and gun powder, all readily available.

Yet another object is to provide a simple process involving only a temperature control for producing the powdered fuel.

These, and other objects, will be readily evident, upon a study of the following specification.

A powdered fuel of the present invention is manufactured by use of only the following six ingredients, comprising: powdered charcoal, powdered hard coal, powdered grain chaff, gun powder, alcohol and water. These ingredients are used in the following relative proportional percentages:

| | |
|---|---|
| Wood charcoal (powder) | 25 percent |
| Hard coal (powder) | 25 percent |
| Grain chaff (powder) | 25 percent |
| Gun powder | 20 percent |
| Alcohol | 3 percent |
| Water | 2 percent |

-continued

| | |
|---|---|
| Total | 100 percent |

The process for use with these ingredients to produce powdered fuel necessitates only the control of temperatures during the process. There is no need of any control of pressures during the process.

The process comprises mixing the ingredients together, under such conditions so that the alcohol will not evaporate away during the mixing, which accordingly is done inside a closed container, such as a tank.

The wood charcoal powder is first brought to a temperature of 600 degrees Fahrenheit (158 degrees Centigrade). These are then placed in the tank together, at their above indicated temperatures. The other dry ingredients, hard coal and gun powder at normal temperatures, are then added thereto in the stated succession, and the dry ingredients are thoroughly mixed. Thereafter, a mixture of the alcohol and water is added thereto, and further mixed for completing the process.

The resultant powdered fuel is then used in an internal combustion engine, which is designed specifically for receiving the same, and burning the same in substitution of gasoline.

While various changes may be made in the detail formula, and in the process, it is understood that such changes will be within the spirit and scope of the present invention, as is defined by the appended claims.

What I now claim is:

1. A powdered fuel product, which comprises a mixture of 95 percent dry ingredients consisting of 25 percent powdered wood charcoal, 25 percent powdered hard coal, 25 percent powdered grain chaff and 20 percent gun powder, and a mixture of 5 percent of liquid ingredients, consisting of 3 percent alcohol and 2 percent water, said dry and said liquid mixtures being mixed together.

2. A process of making a powdered fuel product, wherein an ingredient of powdered wood charcoal is first heated to six hundred degrees Farenheit (three hundred and sixteen degrees Centigrade) and is then thoroughly mixed with other dry ingredients, comprising powdered grain chaff, powdered hard coal and gun powder, so as to form a mixture which subsequently is then mixed with liquid ingredients, comprising alcohol and water, and the last said mixing is done in an enclosed tank, so as to prevent evaporation of said alcohol.

* * * * *